US009145018B2

(12) United States Patent
Kondo

(10) Patent No.: US 9,145,018 B2
(45) Date of Patent: Sep. 29, 2015

(54) PRINTER

(71) Applicant: BROTHER KOGYO KABUSHIKI KAISHA, Nagoya-shi (JP)

(72) Inventor: Kazuyuki Kondo, Kuwana (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/477,385

(22) Filed: Sep. 4, 2014

(65) Prior Publication Data

US 2015/0217584 A1 Aug. 6, 2015

(30) Foreign Application Priority Data

Feb. 5, 2014 (JP) ..... 2014-020202

(51) Int. Cl.
*B41J 23/00* (2006.01)
*B41J 25/00* (2006.01)

(52) U.S. Cl.
CPC ..... *B41J 25/001* (2013.01)

(58) Field of Classification Search
CPC ..... B41J 25/001; B41J 23/00
USPC ..... 347/37
See application file for complete search history.

(56) References Cited

U.S. PATENT DOCUMENTS

| | | | | |
|---|---|---|---|---|
| 5,774,141 | A * | 6/1998 | Cooper et al. | 347/34 |
| 6,267,466 | B1 * | 7/2001 | Gudaitis et al. | 347/37 |
| 6,464,328 | B1 * | 10/2002 | Hiramatsu et al. | 347/34 |
| 2009/0213167 | A1 * | 8/2009 | Motooka et al. | 347/19 |

FOREIGN PATENT DOCUMENTS

JP 2013-028443 A 2/2013

* cited by examiner

*Primary Examiner* — Alessandro Amari
*Assistant Examiner* — Michael Konczal
(74) *Attorney, Agent, or Firm* — Fox Rothschild LLP

(57) ABSTRACT

A printer feeds a print medium in a first direction. A carriage reciprocates an ejection portion in a second direction orthogonal to the first direction. A side wall portion of a frame body has a first surface which is an external surface on a first side of the frame body, extending toward a third direction along liquid ejection. An upper wall of the frame body has a second surface which is an external surface on the first side of the frame body, extending toward the first side from an end portion of the side wall portion on a side of fourth direction opposite to the third direction. An object member having a pattern indicating a position of the carriage in the second direction extends further to the first side than the first surface and further to the third direction side than an opening portion formed on the second surface.

5 Claims, 10 Drawing Sheets

PRINTER

CROSS-REFERENCE TO RELATED APPLICATION

This application claims priority to Japanese Patent Application No. 2014-020202 filed on Feb. 5, 2014, the disclosure of which is herein incorporated by reference in its entirety.

BACKGROUND

The present disclosure relates to a printer that performs printing by ejecting liquid onto a print medium.

An inkjet printer is known which performs printing by ejecting ink from a nozzle onto a print medium, and in which two inkjet heads that are aligned in a direction orthogonal to a scanning direction are taken as one set and four sets of inkjet heads are aligned and arranged in the scanning direction. The inkjet printer is provided with a guide member (a guide shaft), which is a shaft-shaped member that extends in the scanning direction. A guide engagement portion is provided on one end side of a carriage in the direction that is orthogonal to the scanning direction. The guide engagement portion is formed to be engaged with the guide shaft. The carriage is supported with respect to the guide shaft in a state in which the guide shaft is inserted through the guide engagement portion.

The carriage that is supported with respect to the guide shaft by the guide engagement portion reciprocates in the scanning direction by driving of a carriage motor. During this reciprocating movement, ink is selectively ejected from the inkjet heads and lands on the print medium. Thus, an image is recorded on the print medium. In order to detect a movement position of the carriage, the above-described inkjet printer is provided with an encoder strip of a linear encoder. An optical pattern that can be read by an optical sensor is formed on the encoder strip.

SUMMARY

In the above-described inkjet printer, the guide shaft is provided substantially at the center of a housing in the front-rear direction. In order to improve printing quality of the inkjet printer, it is preferable that the encoder strip be provided in the vicinity of the guide shaft. For that reason, when the guide shaft is provided at the center of the interior of the housing, the encoder strip is also provided at the center of the interior of the housing. Inside the housing, in which printing is performed on the print medium, mist is likely to be generated by ink particles becoming very small droplets. If the mist adheres to the encoder strip and the encoder strip is contaminated, it is difficult for the optical sensor to accurately detect the optical pattern. Further, there is a possibility that the mist may float toward the optical sensor. In this case, control of the movement position of the carriage may not be performed accurately, there may be fluctuation in an ejection timing of the ink, and the printing quality of the printer may deteriorate. In order to reduce the adhesion of mist on the encoder strip, it is necessary to additionally provide, for example, a cover member that covers the encoder strip.

Various exemplary embodiments of the general principles described herein provide a printer that can effectively reduce adhesion of ink mist on an encoder strip.

Exemplary embodiments herein provide a printer configured to perform printing by ejecting liquid onto a print medium which is fed in a first direction. The printer is provided with a print head unit, a carriage, a guide shaft, a rail member, a frame body, an object member to be detected, and a detection portion. The print head unit has an ejection portion configured to eject the liquid toward the print medium. The carriage is configured such that the print head unit is mounted thereon. The carriage is configured to cause the ejection portion to reciprocate in a second direction. The second direction is a direction that is orthogonal to the first direction. The guide shaft is provided along the second direction and is configured to support the carriage. The rail member is provided along the second direction and is disposed facing the guide shaft. The guide shaft and the rail member are housed on the inside of the frame body. The frame body is configured to support the guide shaft on a first side in the first direction and to support the rail member on a second side which is opposite to the first side in the first direction.

The frame body has a side wall portion and an upper wall portion. The side wall portion has a first surface. The first surface is an external surface on the first side of the frame body, and is a surface which extends toward a third direction in which the ejection portion ejects the liquid. The upper wall portion has a second surface. The second surface is an external surface on the first side of the frame body, and is a surface which extends toward the first side from an end portion of the side wall portion on a fourth direction side. The fourth direction is a direction that is opposite to the third direction. The second surface has an opening portion which extends along the second direction.

The object member to be detected extends in a strip shape along the second direction, further to the first side than the first surface and further to the third direction side than the opening portion. A pattern indicating a position of the carriage in the second direction is formed on the object member to be detected. The detection portion is configured to output a detection signal based on the pattern. The detection portion is fixed to a first end portion which is an end portion on the first side of the carriage. The detection portion is provided such that it penetrates the opening portion from the fourth direction side with respect to the opening portion and protrudes toward the third direction side.

BRIEF DESCRIPTION OF THE DRAWINGS

Exemplary, embodiments will be described below in detail with reference to the accompanying drawings in which.

DETAILED DESCRIPTION

Hereinafter, an embodiment will be explained with reference to the drawings. First, a schematic structure of a printer 1 will be explained with reference to FIG. 1 to FIG. 3. Note that the upper side, the lower side, the lower right side, the upper left side, the upper right side and the lower left side of FIG. 1 respectively correspond to the upper side, the lower side, the front side, the rear side, the right side and the left side of the printer 1.

Figure 1:
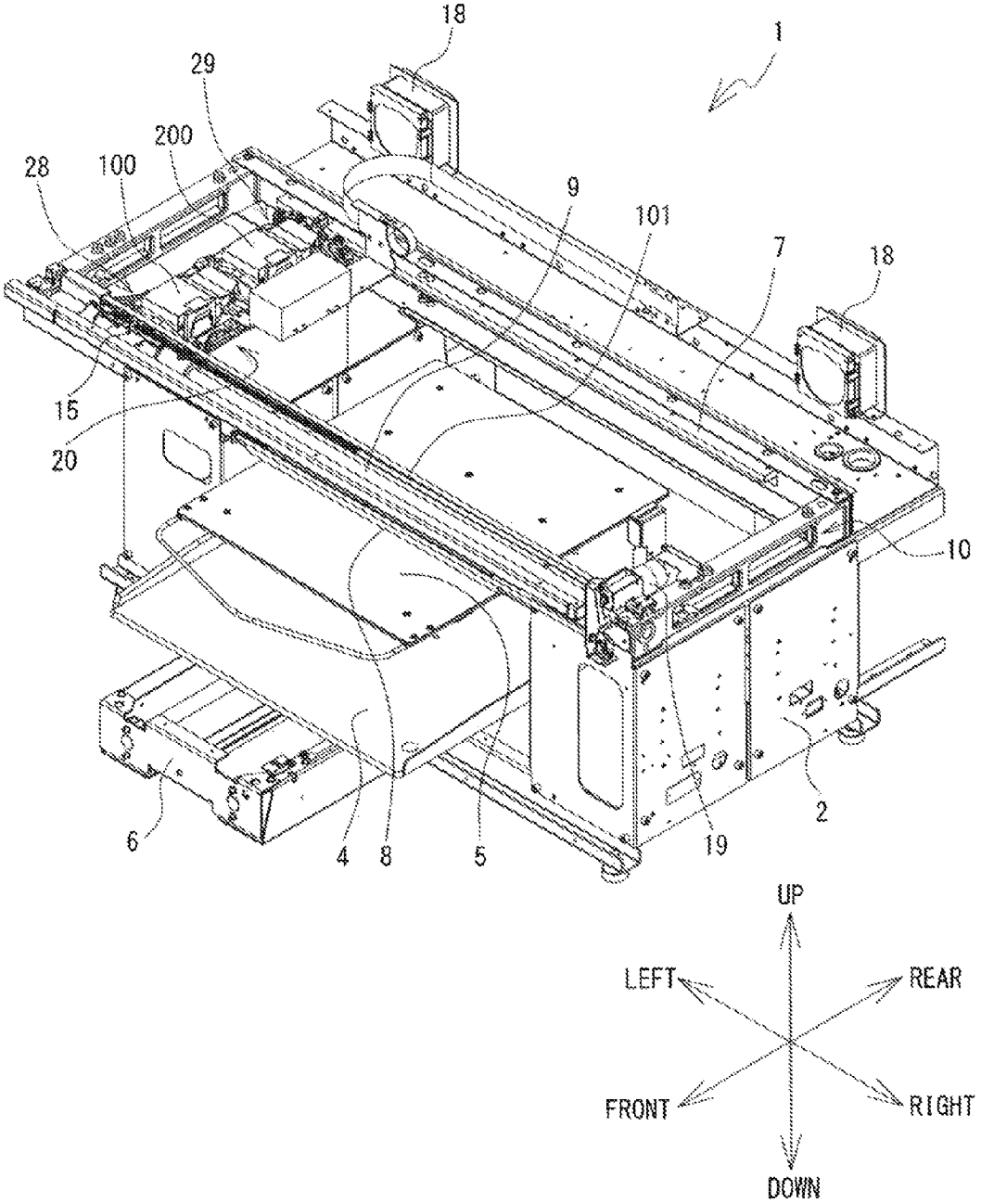
FIG. 1 is a perspective view of a printer.

As shown in FIG. 1, the printer 1 is an inkjet printer that performs printing by ejecting liquid ink onto a cloth (such as a T-shirt or the like, not shown in the drawings), which is a print medium. The printer 1 may use paper etc. as the print medium. In the present embodiment, the printer 1 can print color images on the print medium by downwardly ejecting five types of ink (white (W), black (K), yellow (Y), cyan (C) and magenta (M) inks) that are different from each other. In the explanation below, of the five types of ink, the white color ink is referred to as a white ink, and the inks of the four colors of black, cyan, yellow and magenta are collectively referred to as color inks. In the explanation below, the feed direction (the front-rear direction, the sub-scanning direction) in which the printer 1 feeds the print medium is also referred to as a first direction, and a direction (the left-right direction, the scanning direction) that is orthogonal to the first direction is also referred to as a second direction.

The printer 1 mainly includes a housing 2, a platen drive mechanism 6, a pair of guide rails 3 and 3, a platen 5, a tray 4, a frame body 10, a guide shaft 9, a rail 7, a carriage 20, support portions 21L and 21R, head units 100 and 200, a drive belt 101, a drive motor 19, an encoder strip 30, a board 15 and two fans 18 and 18.

The housing 2 has a substantially cuboid shape that is long in the left-right direction. An operation portion (not shown in the drawings) to perform operations of the printer 1 is provided in a position on the front right side of the housing 2. The operation portion is provided with a display and operation buttons. The display displays various types of information. The operation buttons are operated when a user inputs commands relating to various types of operations of the printer 1.

Figure 2:
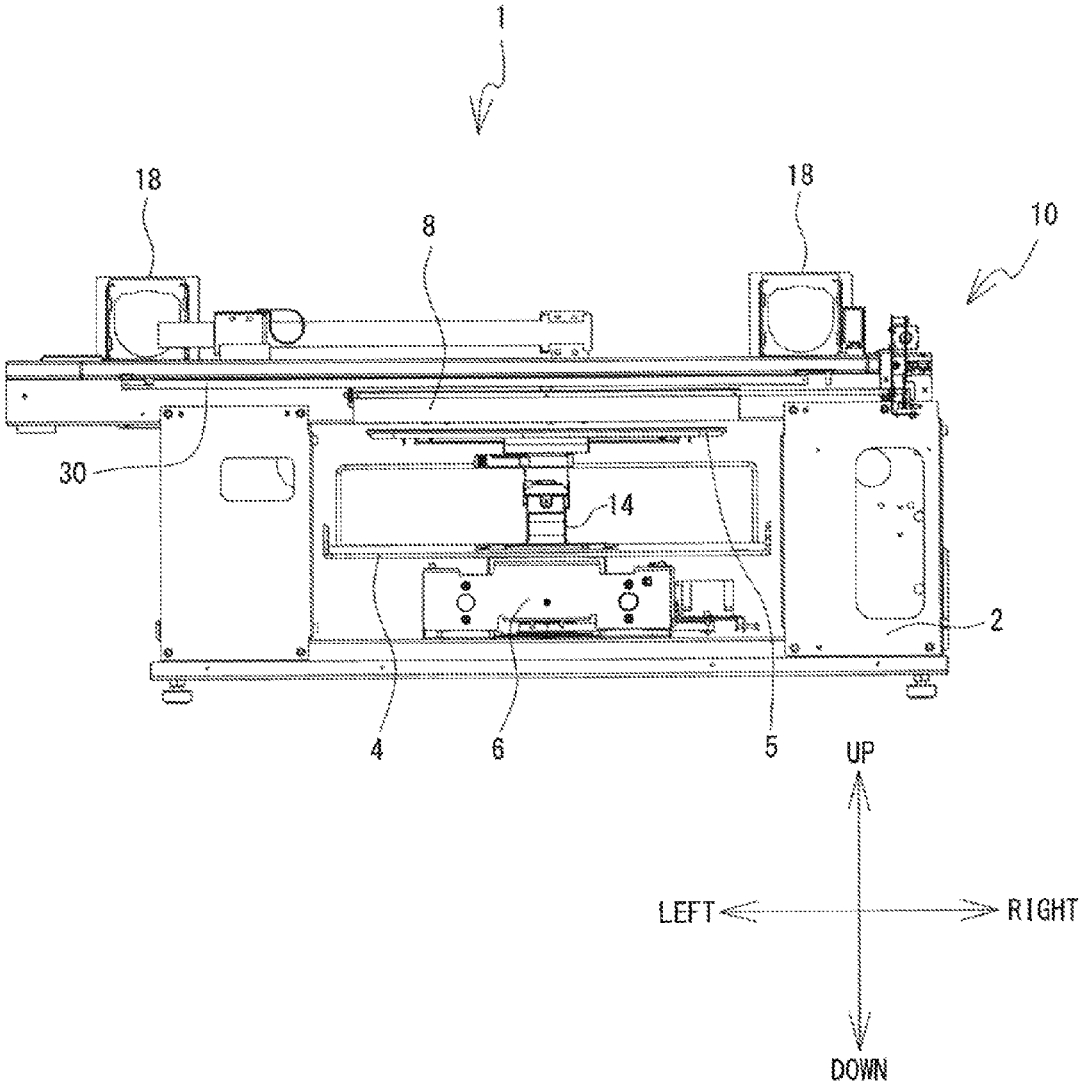
FIG. 2 is a front view of the printer.
Figure 3:
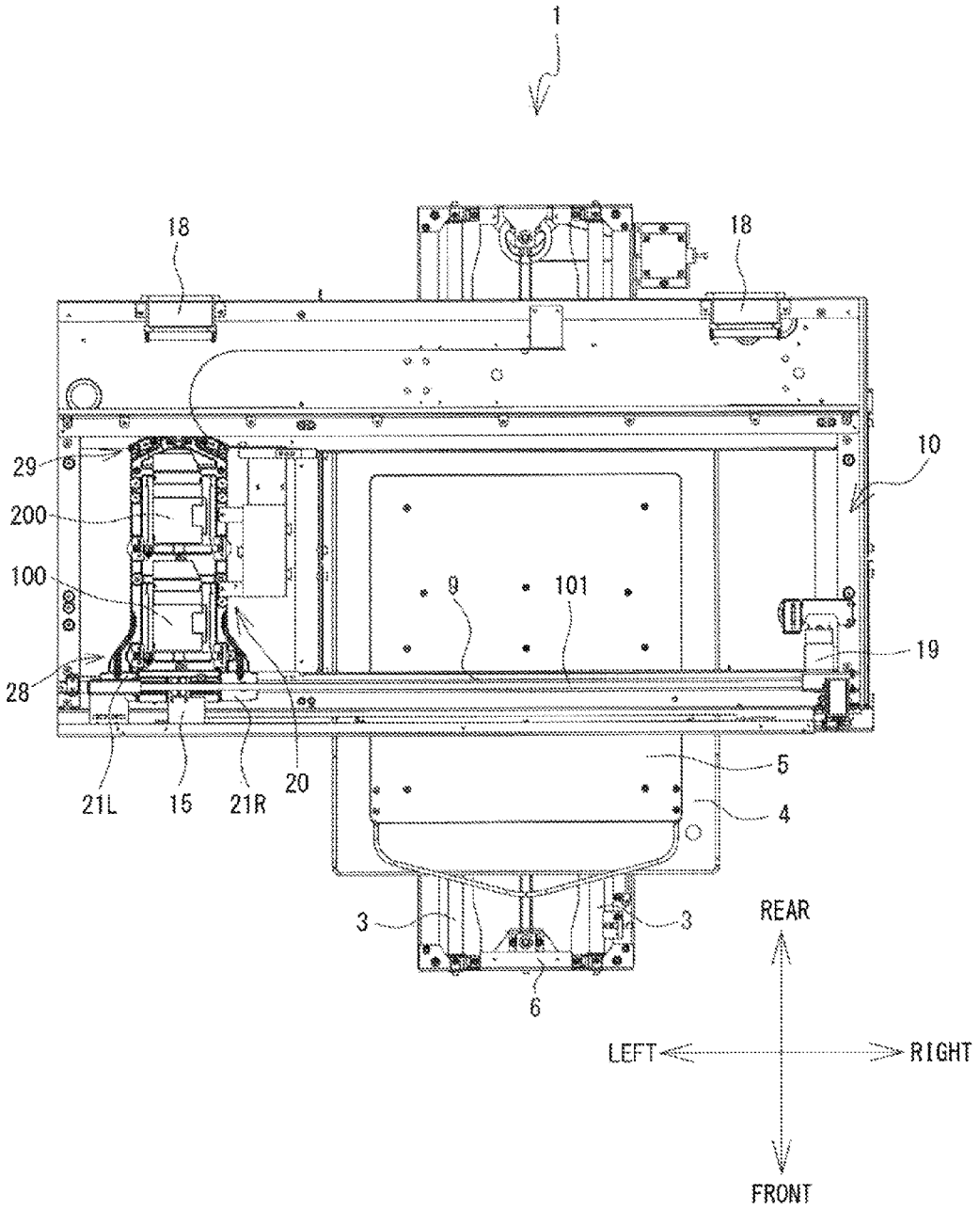
FIG. 3 is a plan view of the printer.

The platen drive mechanism 6 is provided with the pair of guide rails 3 and 3 (refer to FIG. 3) and a platen support base 14 (refer to FIG. 2). The pair of guide rails 3 and 3 support the platen support base 14 such that the platen support base 14 can be conveyed in the front-rear direction. The tray 4 is fixed to the lower end of a support pillar that stands substantially at the center of the platen support base 14. The platen 5 is fixed to the upper end of the support pillar. The platen drive mechanism 6 uses, as a driving source, a motor (not shown in the drawings) that is provided on a rear end portion of the platen drive mechanism 6, and thus moves the platen support base 14 in the front-rear direction of the housing 2 along the pair of guide rails 3 and 3. The platen 5 has a substantially rectangular plate shape in a plan view, and its long sides extend in the front-rear direction of the housing 2. The platen 5 is provided below the frame body 10, which will be described later. The print medium (a T-shirt, for example) made of cloth is to be placed on the top surface of the platen 5. The tray 4 has a rectangular shape in a plan view and is provided below the platen 5. When the user places a T-shirt or the like on the platen 5, the tray 4 receives a sleeve or the like of the T-shirt and thus protects it such that the sleeve or the like does not come into contact with a member of the housing 2.

The frame body 10 has a substantially rectangular frame shape in a plan view. The frame body 10 is provided on an upper portion of the housing 2. A clearance sensor 8 is provided in a position on the front side of the frame body 10 along the left-right direction of the frame body 10. The clearance sensor 8 detects obstacles, such as wrinkling of the cloth placed on the platen 5 or dirt, when the platen 5 moves in the front-rear direction inside the housing 2 along the pair of guide rails 3 and 3 during printing by the printer 1.

The frame body 10 supports the guide shaft 9 on the front side of the frame body 10 in the front-rear direction, and supports the rail 7 on the rear side that is opposite to the front side, on the inside of the frame body 10. The guide shaft 9 is a shaft member that is provided with a shaft-shaped portion that extends in the second direction on the inside of the frame body 10. The rail 7 is a rod-shaped member that extends in the second direction, and is disposed facing the guide shaft 9. The guide shaft 9 and the rail 7 are separated from each other in the front-rear direction. In the explanation below, the front side in the first direction (the front-rear direction), in which the printer 1 feeds the print medium, is also referred to as one side, and the rear side, which is in the opposite direction to the one side, is also referred to as the other side.

The carriage 20 is supported by the guide shaft 9 such that the carriage 20 can be conveyed in the left-right direction along the guide shaft 9. The support portions 21L and 21R are provided on a first end portion 28, which is one end portion of the carriage 20 in the first direction. The guide shaft 9 is inserted through the support portions 21L and 21R. The support portions 21L and 21R support the carriage 20 such that the carriage 20 can slide along the guide shaft 9. In other words, the support portions 21L and 21R each have a cylindrical shape that engages with the guide shaft 9. Although not shown in the drawings, a bearing mechanism is provided inside of each of the support portions 21L and 21R. Therefore, the carriage 20 slides smoothly along the guide shaft 9. The head units 100 and 200 are mounted on the carriage 20. The bottom surfaces of the head units 100 and 200 are respectively provided with head portions 105 and 205 that can eject ink toward the print medium (refer to FIG. 9).

Although not shown in the drawings, along the left-right direction, the interior of each of the head portions 105 and 205 is divided into four sections corresponding to the respective color inks. A planar ejection surface that is parallel to the horizontal plane is formed on each of the bottom surfaces of the head portions 105 and 205. A plurality of fine ejection ports that can downwardly eject one of the color inks are provided on the ejection surface. The plurality of ejection ports are arrayed in one row in the front-rear direction from the front side of the ejection surface to the rear, and are arrayed in a plurality of rows in the left-right direction. The plurality of ejection ports correspond to a plurality of ejection channels (not shown in the drawings) that are provided inside of each of the head portions 105 and 205. The plurality of ejection channels are provided such that ink can be ejected downward from the corresponding ejection ports as a result of the driving of a plurality of piezoelectric elements (not shown in the drawings) that are provided inside of each of the head portions 105 and 205. More specifically, the head portion 105 includes an ejection port group having a plurality of ejection ports that eject black ink, an ejection port group having a plurality of ejection ports that eject cyan ink, an ejection port group having a plurality of ejection ports that eject yellow ink, and an ejection port group having a plurality of ejection ports that eject magenta ink. Further, the head portion 205 ejects white ink. The head portion 205 is divided into four sections similarly to the head portion 105. However, the head portion 205 is configured to eject white ink from all the ejection ports. In the explanation below, the downward direction, which is the direction in which the head portions 105 and 205 of the respective head units 100 and 200 eject the ink, is also referred to as a third direction, and the upward direction that is the opposite direction to the third direction is also referred to as a fourth direction.

The drive belt 101 is strip-shaped and is stretched along the left-right direction on the inside of the frame body 10. The drive belt 101 is made of a synthetic resin having flexibility. The drive motor 19 is provided on the inside of the frame body 10, in a position on the front right side of the frame body 10. The drive motor 19 is provided between the guide shaft 9 and the rail 7 in the front-rear direction. The drive motor 19 can rotate in the forward direction and the reverse direction, and is connected to the carriage 20 via the drive belt 101. When the drive motor 19 drives the drive belt 101, the carriage 20 is caused to reciprocate in the second direction. The carriage 20 causes the head portions 105 and 205 of the respective head units 100 and 200 to move in the second direction, which is the direction orthogonal to the first direction.

As shown in FIG. 2, the encoder strip 30 extends in a strip shape in the second direction, on the outside of the one side of the frame body 10. The encoder strip 30 is made of a transparent synthetic resin. A pattern that indicates a position of the carriage 20 in the second direction is formed on the encoder strip 30.

The board 15 is a circuit board, and its lower surface is provided with an optical sensor 151 (refer to FIG. 6 and FIG. 8) that detects the position of the carriage 20 in the second direction. The board 15 is fixed to the carriage 20 and is configured to move in the second direction in accordance with the reciprocating movement of the carriage 20 in the second direction.

The two fans 18 and 18 are respectively provided on rear end portions of the frame body 10. The two fans 18 and 18 may be general purpose fans. The two fans 18 and 18 discharge air from the one side toward the other side. In the present embodiment, the carriage 20 is disposed on the inside of the frame body 10. In other words, printing is performed on the print medium by the printer 1 in an area on the inside of the frame body 10. Further, the platen 5 feeds the print medium in the front-rear direction inside the housing 2. Therefore, when printing is performed, there are cases in which mist is generated by ink particles in the printing area on the inside of the frame body 10, which is inside the housing 2. The mist is generated as a result of the ink ejected from the head portions 105 and 205 of the respective head units 100 and 200 becoming very small droplets. When the mist is generated, it is possible that the generated mist is dispersed inside the housing 2. The two fans 18 and 18 can discharge the mist generated in the printing area on the inside of the frame body 10, from the printing area on the inside of the frame body 10 and from inside the housing 2 toward the rear side, together with the air on the inside of the frame body 10.

Figure 4:
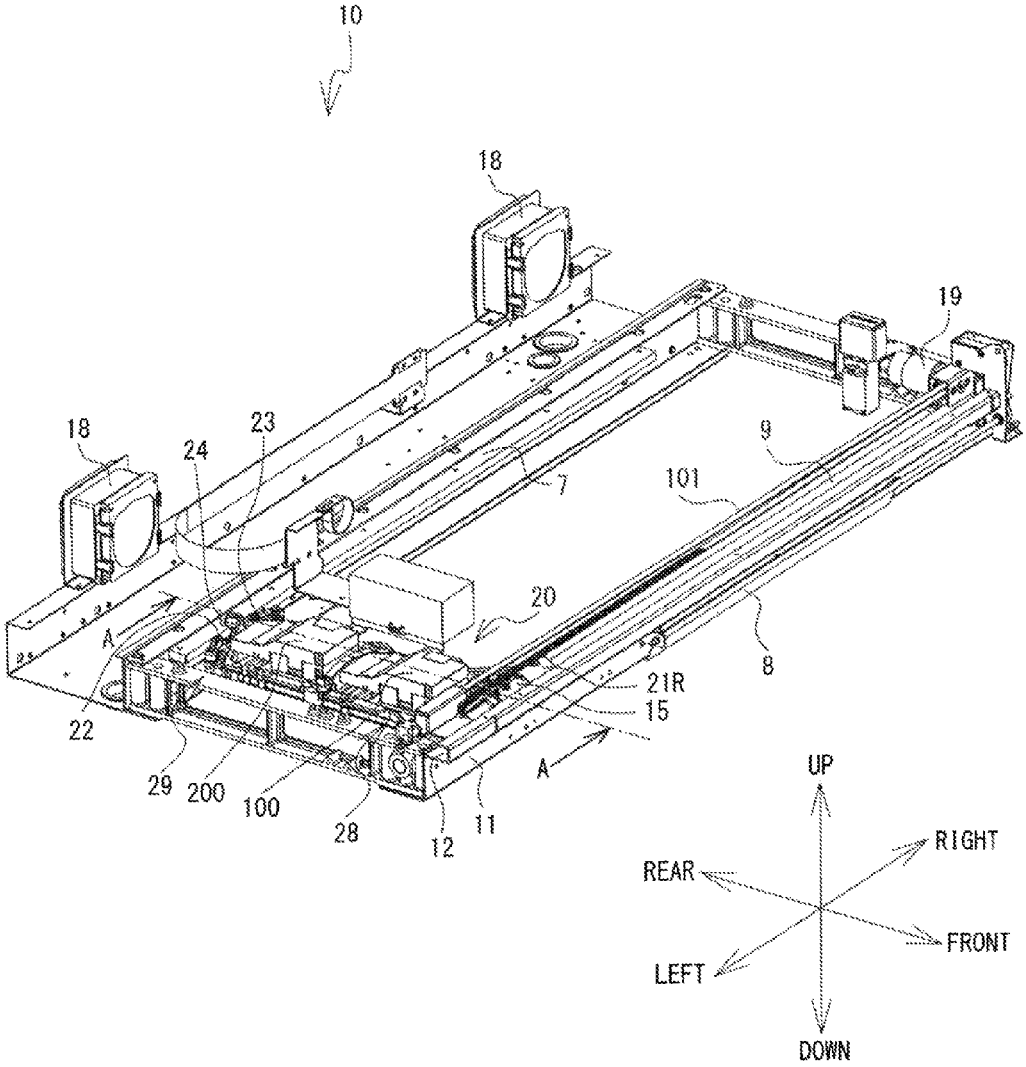
FIG. 4 is a perspective view of a frame body.

The frame body 10 will be explained in detail with reference to FIG. 4. The frame body 10 supports the guide shaft 9 on the front side of the frame body 10 and supports the rail 7 on the rear side, on the inside of the frame body 10. The carriage 20 is disposed in the front-rear direction between the guide shaft 9 and the rail 7. A left side roller 22, a right side roller 23 and an upper side roller 24 are provided on a second end portion 29, which is an end portion of the carriage 20 on the opposite side to the first end portion 28 (namely, the second end portion 29 is on the rear side of the carriage 20). The left side roller 22 and the right side roller 23 run while pressing the front end face of the rail 7, which is on a side (the front side) that faces the guide shaft 9. The upper side roller 24 comes into contact with the upper end face on the fourth direction side of the rail 7, and runs on the upper end face of the rail 7 while regulating the movement of the carriage 20 to the third direction side. In other words, the second end portion 29 of the carriage 20 is in contact with the rail 7 at the left side roller 22, the right side roller 23 and the upper side roller 24.

The mounted state of the head portions 105 and 205 onto the carriage 20 exerts an influence on the printing quality. Therefore, when the head portions 105 and 205 are mounted onto the carriage 20, it is necessary to perform positioning between the carriage 20 and the head portions 105 and 205 with very high precision. For example, when head portions are mounted onto the carriage 20, there are cases in which each of the head portions that ejects one type of ink is individually positioned and mounted onto the carriage 20. An operation to individually mount each of the head portions onto the carriage 20 in a narrow operation area is complicated. In a known printer, in order to secure an operation space for the user to accurately perform the mounting operation, a component corresponding to the rail 7 is disposed on the front side, which is the side near to the user, and a component corresponding to the guide shaft 9 is disposed on the rear side. In the present embodiment, the interior of each of the head portions 105 and 205 of the head units 100 and 200 is divided into four sections. In other words, the single head unit can eject four types of ink. Therefore, the operation to mount the head portions 105 and 205 onto the carriage 20 can be performed more easily than in the known art. Therefore, in the printer 1 of the present embodiment, even when the guide shaft 9 is disposed on the front side of the frame body 10 and the rail 7 is disposed on the rear side of the frame body 10, there is no need to secure an extra wide space for the operation of the user.

The head units 100 and 200 are arrayed in the first direction on the carriage 20. The head unit 100 is positioned to the front of the head unit 200. The head units 100 and 200 can reciprocate along the guide shaft 9 in the left-right direction on the inside of the frame body 10. The head unit 100 can eject the color inks and the head unit 200 can eject the white ink.

In the present embodiment, when the color of the print medium is dark, for example, before the color inks are ejected, the white ink is ejected onto all or a part of the area to be printed, as a base for printing. In summary, the white ink is a pre-treatment ink. After the white ink has been ejected onto all or a part of the area to be printed, the color inks are used to print a pattern etc. on that area. In summary, each of the color inks is a post-treatment ink. In other words, the head unit 200 is a head unit for pre-treatment, and the head unit 100 is a head unit for post-treatment. Note that the white ink is also used as the post-treatment ink to print a pattern etc. In this manner, the printer 1 can perform various types of printing regardless of the color of the print medium.

If the head units 100 and 200 are arrayed in the second direction, normally, after all the printing for pre-treatment that is necessary for the print medium has been performed, the printing for post-treatment is then performed. In this case, after all the printing for pre-treatment in the printing area is completed, the platen is moved to a printing start position again, and the printing for post-treatment is performed on the printing area. Therefore, it is difficult for the user to improve production efficiency. In the present embodiment, the printer 1 performs printing by arraying the head units 100 and 200 in the first direction. In this case, the positions of the respective head units 100 and 200 in the left-right direction are the same. Therefore, by the head unit 100 ejecting the color inks immediately after the head unit 200 ejects the white ink, the printer 1 can perform the printing for pre-treatment and the printing for post-treatment almost simultaneously. More specifically, when the head units 100 and 200 are arranged side by side in the first direction, it is possible to perform the printing for pre-treatment and the printing for post-treatment in the same process. Thus, the printer 1 can improve production efficiency without reducing printing precision.

With regard to the pre-treatment ink and the post-treatment inks, depending on the color of the print medium and a printing image, the color inks for post-treatment need not necessarily be ejected after the white ink for pre-treatment has been ejected. More specifically, there may be an area onto which the white ink for pre-treatment only is ejected or an area onto which the color inks for post-treatment only are ejected. Further, although in the present embodiment, the white ink is used as the pre-treatment ink and the color inks are used as the post-treatment inks, the combination of the pre-treatment ink and the post-treatment inks and the ink type etc. can be changed as appropriate and are not limited to the case of the present embodiment.

Figure 5:
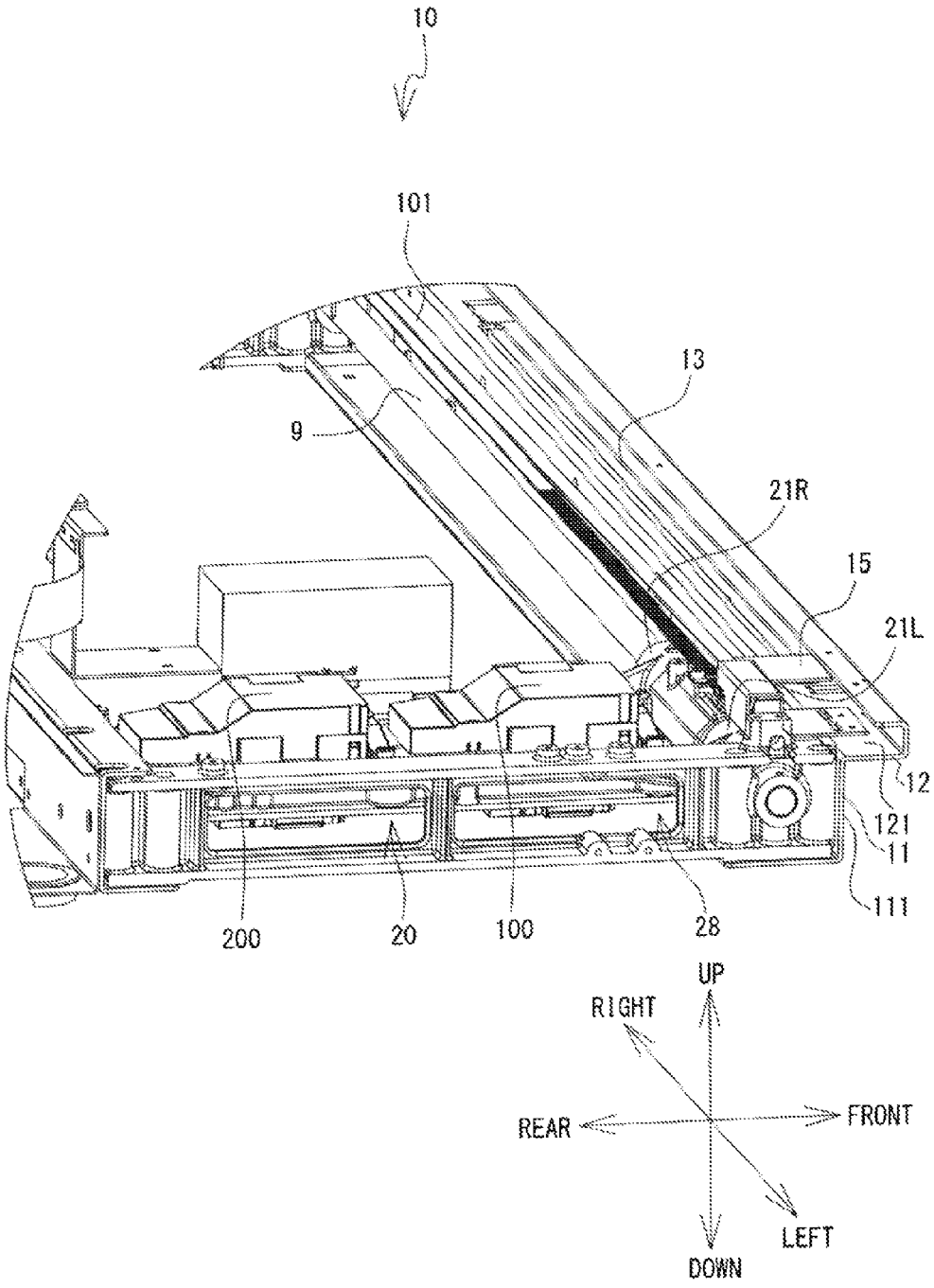
FIG. 5 is an enlarged perspective view of the frame body as viewed from the rear left side.

The structure of a one side portion of the frame body 10 will be explained in detail with reference to FIG. 5 and FIG. 6. The frame body 10 is provided with a side wall portion 11. The side wall portion 11 has a front surface 111. The front surface 111 is a surface that extends from an upper portion of the frame body 10 toward the third direction, and is provided along the outside of the one side of the frame body 10. In other words, the front surface 111 corresponds to a side surface on the outside of the one side of the frame body 10. The side wall portion 11 covers the side surface on the outside of the one side of the frame body 10 across the left-right direction.

The frame body 10 is provided with an upper wall portion 12 that protrudes, like an overhang, to the above-described one side from the upper end of the side wall portion 11. The upper wall portion 12 has a top surface 121. The top surface 121 is a surface that extends to the one side from an end portion of the side wall portion 11 on the fourth direction side. An opening portion 13 is formed in the top surface 121 such that the opening portion 13 extends along the second direction. The opening portion 13 is provided so as to penetrate in the thickness direction of the upper wall portion 12. In other words, the upper wall portion 12 is disposed on an end portion on the one side of the frame body 10 such that the upper wall portion 12 overhangs the outside of the frame body 10. Therefore, the opening portion 13 is also disposed on the end portion on the one side of the frame body 10 such that the opening portion 13 overhangs the outside of the frame body 10. The length of the opening portion 13 in the left-right direction corresponds to the length of the guide shaft 9 in the left-right direction.

Figure 6:
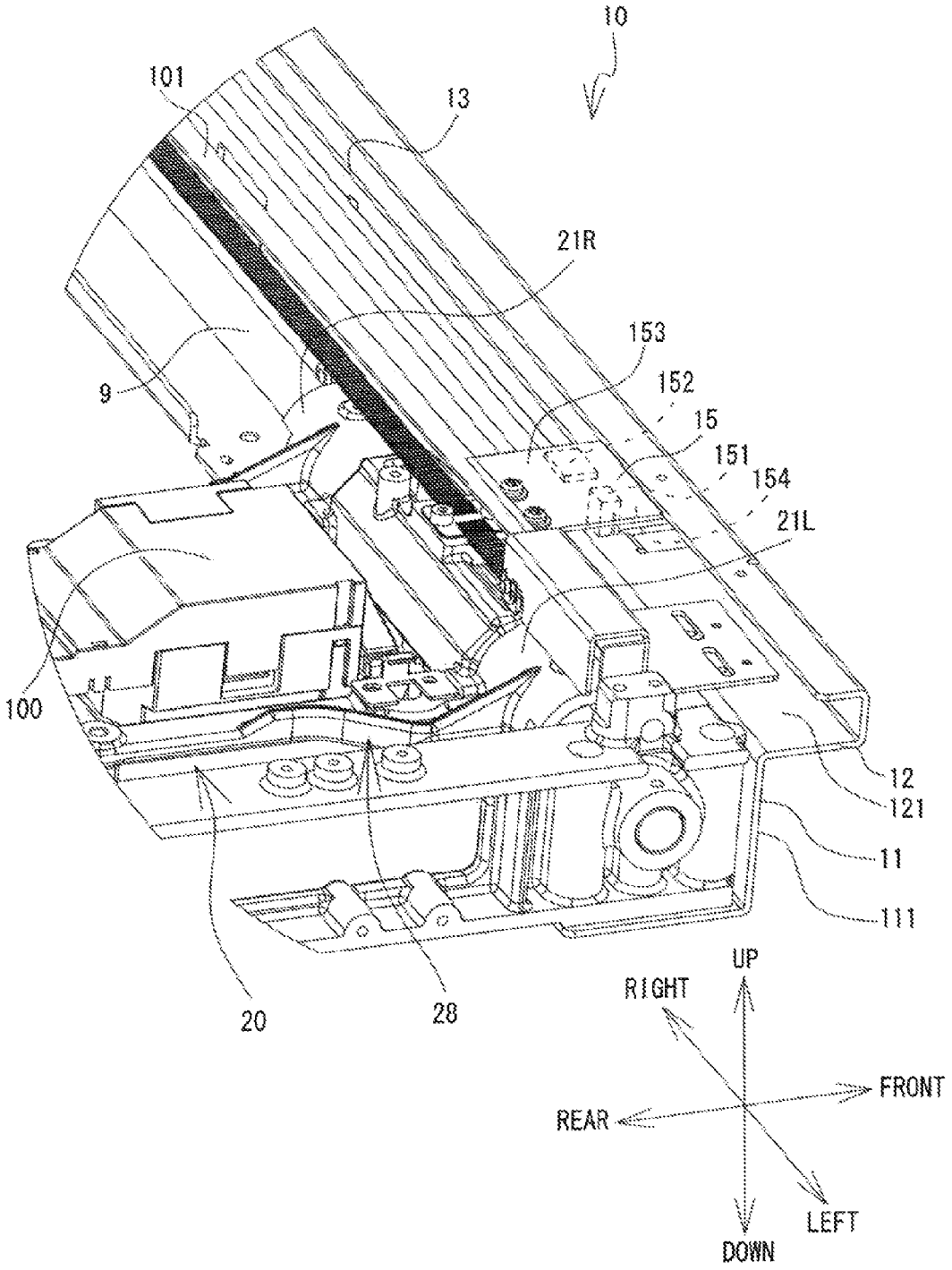
FIG. 6 is an enlarged perspective view of the frame body as viewed from the rear left side.

As shown in FIG. 6, the board 15 is fixed to the first end portion 28 of the carriage 20. Specifically, an end portion on the other side of the board 15 is screwed to the first end portion 28 of the carriage 20 from the side of an upper side surface 153, which is the upper side surface of the board 15. An end portion on the one side of the board 15 extends toward the fourth direction side of the opening portion 13 along the top surface 121 such that a lower side surface 154, which is on an opposite side to the upper side surface 153, is directed downward. The optical sensor 151 and an IC 152, which is a semiconductor integrated circuit, are mounted on the lower side surface 154.

The optical sensor 151 is a transmission sensor that incorporates a projector and a light receiver. The projector incorporates a light source and projects light, which is a detection medium. The light receiver receives the light projected from the projector and converts the light into an electrical signal. The optical sensor 151 is configured to detect ON and OFF based on whether or not there is light transmission between the projector and the light receiver, which are disposed facing each other. The optical sensor 151 is electrically connected to the board 15 on the lower side surface 154. In other words, the optical sensor 151 is fixed to the first end portion 28 of the carriage 20 via the board 15. In summary, the optical sensor 151 is attached to the carriage 20. The optical sensor 151 protrudes from the fourth direction side of the opening portion 13 toward the third direction side (refer to FIG. 8). The IC 152 is electrically connected to the board 15 on the lower side surface 154. The IC 152 is provided with an electronic circuit to output position information of the carriage 20 in the second direction. The IC 152 of the present embodiment is an integrated circuit that is provided with the electronic circuit to output the position information of the carriage 20. The IC 152 may be a general-purpose semiconductor integrated circuit.

Figure 7:
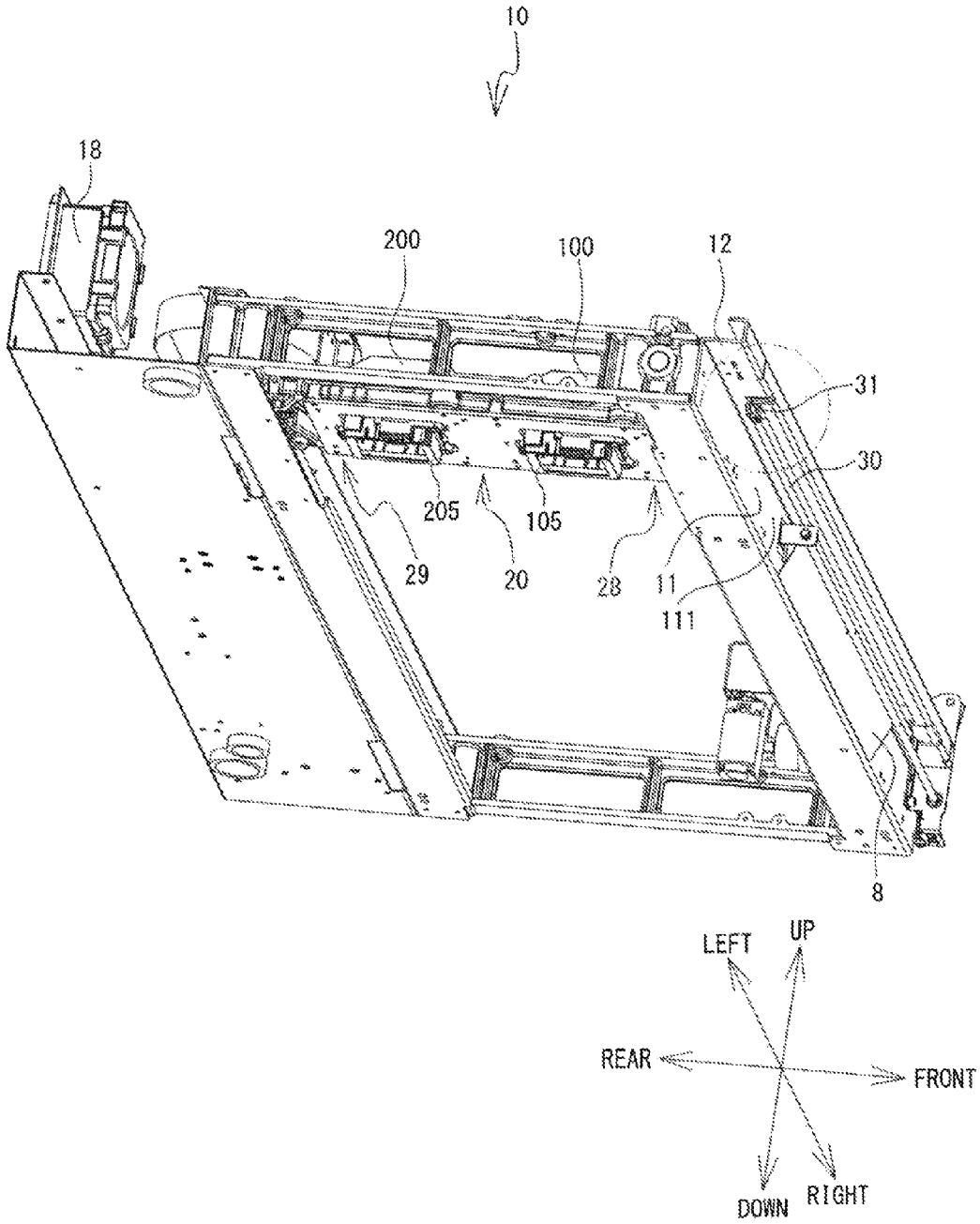
FIG. 7 is a perspective view of the frame body as viewed from the lower left side.

The arrangement of the encoder strip 30 and the optical sensor 151 will be explained in detail with reference to FIG. 7 to FIG. 10. As shown in FIG. 7, the encoder strip 30 is disposed further to the one side than the front surface 111 and is also disposed further to the third direction side than the opening portion 13. The encoder strip 30 is used to detect the position of the carriage 20 in the second direction.

Figure 8:
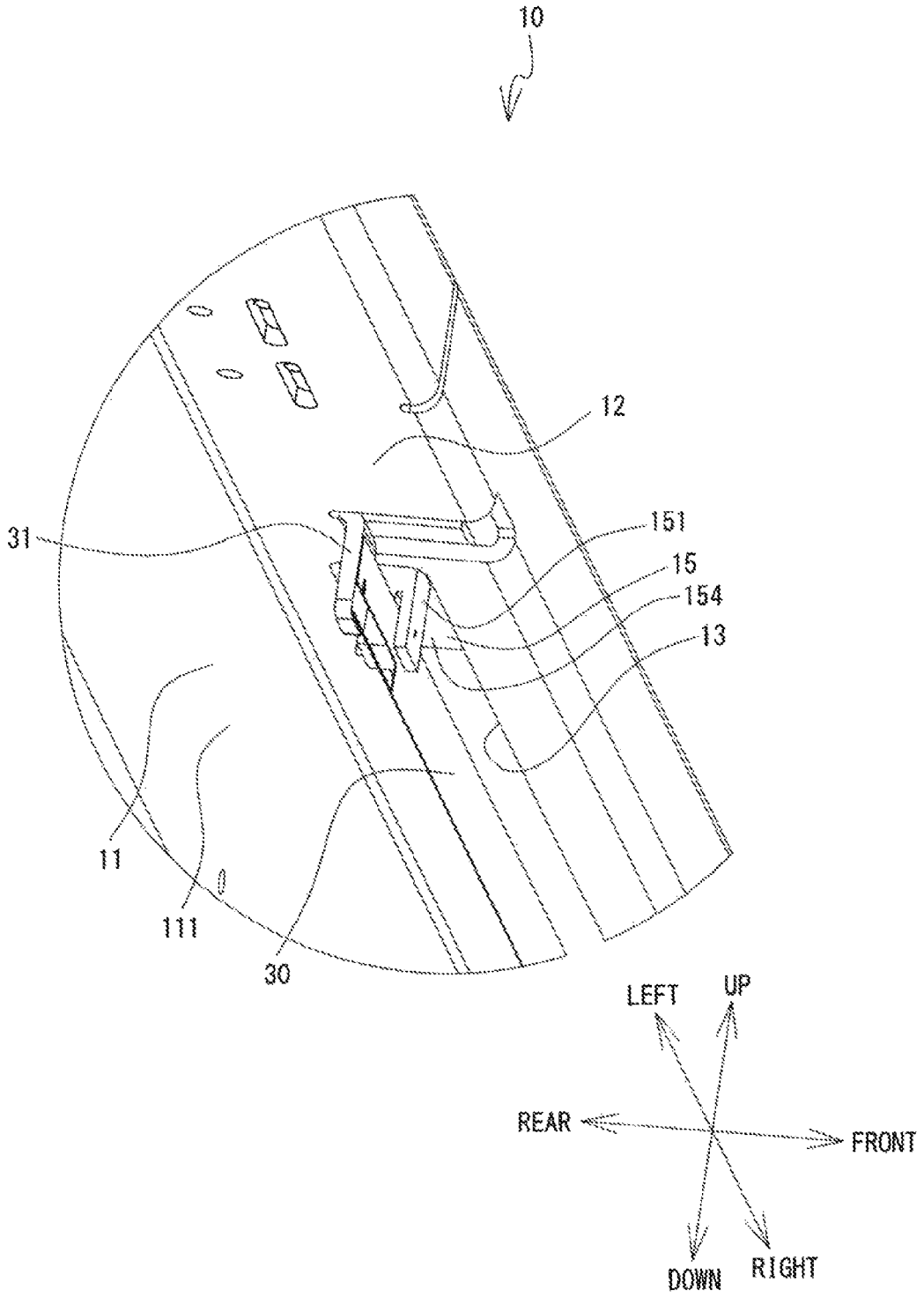
FIG. 8 is an enlarged perspective view of the frame body as viewed from the lower left side.

As shown in FIG. 7 and FIG. 8, a rib 31 is formed in a position corresponding to the left end of the encoder strip 30. The rib 31 is provided in a standing condition and extends downward from the upper wall portion 12. That is, the left end of the encoder strip 30 is locked by the rib 31. In a similar manner to the left end, the right end of the encoder strip 30 is locked by a rib (not shown in the drawings) which is formed in a position corresponding to the right end of the encoder strip 30, and which is provided in a standing condition and extends downward from the upper wall portion 12. In this manner, the encoder strip 30 is disposed along the left-right direction in which the carriage 20 reciprocates.

Figure 10:
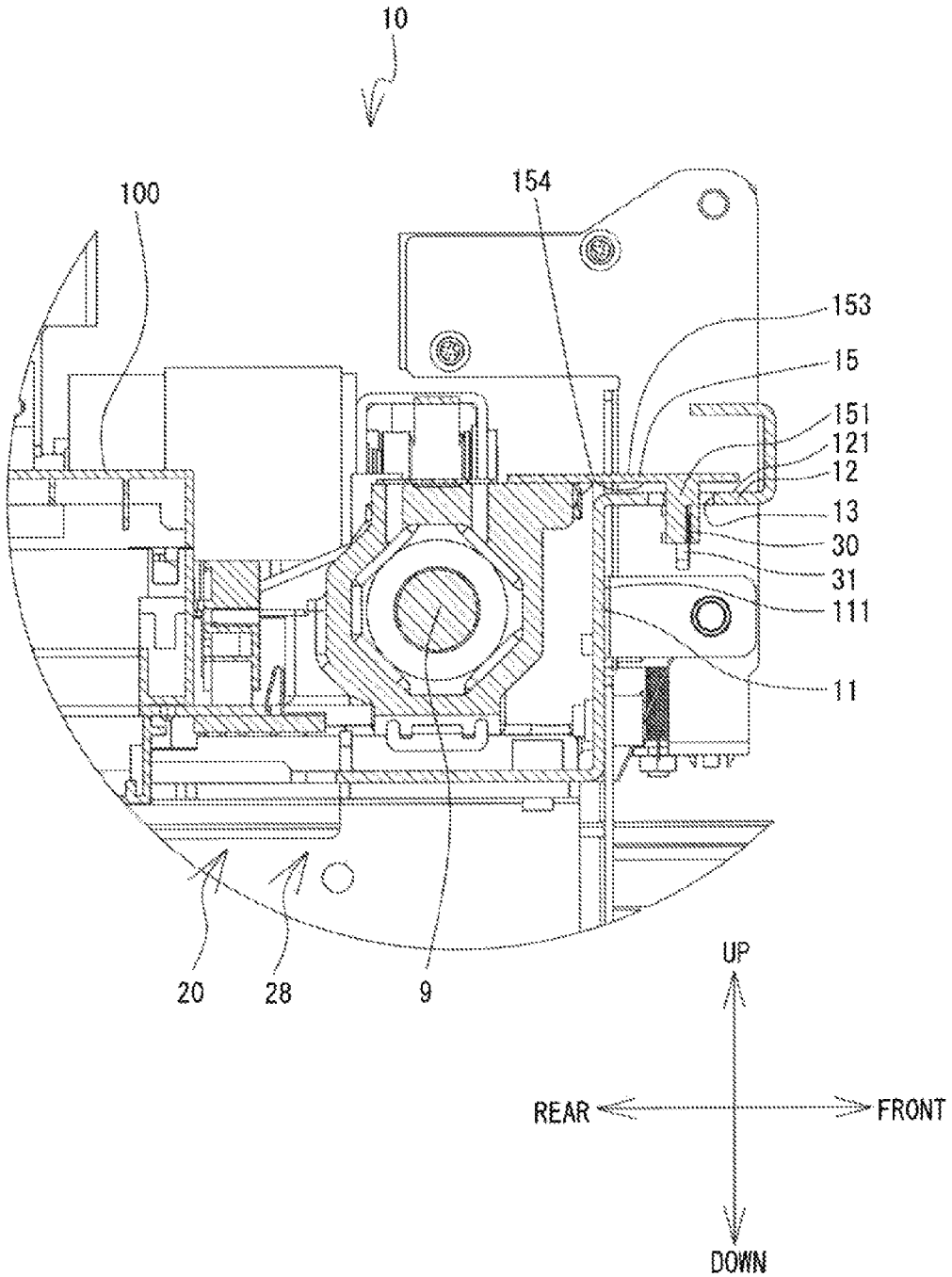
FIG. 10 is an enlarged sectional view of a front portion of the frame body shown in FIG. 9.

A displacement detection pattern is formed on the encoder strip 30 as a pattern that indicates the position of the carriage 20 in the second direction. On the displacement detection pattern, a light transmitting portion that allows light to pass through it and a light shielding portion that blocks light are alternately arranged at an equal pitch in the longitudinal direction. In other words, the light shielding portion, which is a line extending in the width direction, is written on the translucent encoder strip 30 at a predetermined interval in the longitudinal direction. As shown in FIG. 8 and FIG. 10, the optical sensor 151 that protrudes downward from the upper side of the opening portion 13 is disposed on the upper side of the encoder strip 30. The optical sensor 151 is disposed such that it covers a part of the encoder strip 30 from above. That is, the optical sensor 151 is configured such that the encoder strip 30 is disposed between the projector and the light receiver that are incorporated in the optical sensor 151. Since the opening portion 13 extends along the second direction, the optical sensor 151 can move in the left-right direction inside the opening portion 13. The optical sensor 151 reciprocates along the longitudinal direction of the encoder strip 30, together with the carriage 20, and detects the displacement detection pattern of the encoder strip 30 during the reciprocating movement.

The optical sensor 151 outputs a detection signal based on the detected displacement detection pattern to the IC 152 (refer to FIG. 6). The IC 152 ascertains the position information of the carriage 20 in the second direction, based on the detection signal output from the optical sensor 151. The IC 152 outputs the ascertained position information of the carriage 20 in the second direction to a control portion that is formed by various electronic elements mounted on the board 15. The control portion outputs the position information of the carriage 20 in the second direction to a main board (not shown in the drawings) that performs main control of the printer 1. The main board controls the rotation of the drive motor 19 and the driving of the plurality of piezoelectric elements provided inside the head portions 105 and 205, based on the position information output from the board 15.

It is preferable that the encoder strip 30 be provided in the vicinity of the guide shaft 9 that supports the carriage 20, because the encoder strip 30 is used to detect the position of the carriage 20 in the second direction. In the known printer, in many cases, a component corresponding to the guide shaft 9 is provided in the vicinity of the center of the interior of the housing, for example, in order to secure the aforementioned operation space for the user. There is also a case in which the encoder strip 30 is provided in the vicinity of the center of the interior of the housing.

The mist generated on the inside of the frame body 10 is scattered upward by the reciprocating movement of the carriage 20 on the inside of the frame body 10, and floats around inside the frame body 10. If the encoder strip 30 is provided on the inside of the frame body 10, the mist that floats around inside the frame body 10 is likely to adhere to the encoder strip 30. If the encoder strip 30 is contaminated by the adhesion of the mist formed of colored ink particles, there is a case in which a light shielding part other than the displacement detection pattern is formed on the encoder strip 30. In this case, it is difficult for the optical sensor 15 to accurately detect the displacement detection pattern, and there is a possibility that the output of the position information of the carriage 20 may not be performed accurately by the board 15. Consequently, the movement control of the carriage 20 may not be performed accurately, there may be fluctuation in an ejection timing by the head portions 105 and 205, and the printing quality of the printer 1 may deteriorate.

In the present embodiment, the guide shaft 9 is provided on the front side of the frame body 10, on the inside of the frame body 10. The encoder strip 30 is disposed on the outside of the one side of the frame body 10 in the vicinity of the guide shaft 9 in a state in which the upper side and the rear side of the encoder strip 30 are surrounded by the upper wall portion 12 and the side wall portion 11, respectively. There is a case in which the mist that floats around inside the frame body 10 floats to the outside of the frame body 10. The mist that floats toward the outside of the one side of the frame body 10 is blocked by the upper wall portion 12 and the side wall portion 11 and is unlikely to reach a location where the encoder strip 30 is disposed. Further, the board 15 is provided such that it protrudes above the opening portion 13. In a state in which a part of the opening portion 13 is blocked from above, the board 15 is conveyed in accordance with the reciprocating movement of the carriage 20 in the second direction. Therefore, the board 15 can inhibit the mist that floats toward the outside of the one side of the frame body 10 from passing through the opening portion 13 and floating below the upper wall portion 12.

Further, as described above, the printer 1 can discharge the mist generated on the inside of the frame body 10 toward the outside of the rear side of the frame body 10, using the two fans 18 and 18 (refer to FIG. 1 etc.). In other words, the two fans 18 and 18 draw the air inside the frame body 10 toward the rear, so that the mist does not float toward the outside of the one side of the frame body 10. Thus, the printer 1 can inhibit the mist generated on the inside of the frame body 10 from floating toward the outside of the one side of the frame body 10. Therefore, by disposing the encoder strip 30 on the one side of the front surface 111 and on the third direction side of the opening portion 13, the printer 1 can suppress the mist from adhering to the encoder strip 30. That is, the printer 1 can reduce the adhesion of the mist on the encoder strip 30 without additionally providing a cover member or the like that covers the encoder strip 30.

Further, based on known technical common knowledge, it is necessary for the user to periodically perform maintenance operations, such as cleaning the encoder strip 30, in order to inhibit the printing quality from deteriorating due to the adhesion of the mist on the encoder strip 30. However, with the structure of the present embodiment, since the mist is blocked by the upper wall portion 12 and the side wall portion 11, the adhesion of the mist on the encoder strip 30 is effectively suppressed and thus the frequency of the maintenance operations is effectively reduced. Incidentally, it is possible that a slight amount of the mist that floats to the outside of the one side of the frame body 10 with failing to be blocked by the upper wall portion 12 and the side wall portion it may adhere to the encoder strip 30. Also in this case, in the present embodiment, since the encoder strip 30 is disposed on the outside of the frame body 10, the user can easily perform the maintenance operations on the encoder strip 30. Thus, the printer 1 can effectively inhibit the deterioration of the printing quality.

When the mist adheres to the optical sensor 15, there is also a possibility of deterioration in the printing quality of the printer 1. Specifically, when the mist adheres to the projector and the light receiver of the optical sensor 151, it becomes difficult to accurately detect the displacement detection pattern of the encoder strip 30, and there is a possibility that the output of the position information of the carriage 20 may not be performed accurately by the board 15. The light receiver has properties to convert the projected light received from the projector into an electrical signal. Therefore, particularly, when the mist adheres to the projector, the performance of the optical sensor 151 is likely to deteriorate.

As shown in FIG. 8 and FIG. 10, the optical sensor 151 is disposed on the lower side surface 154. Therefore, even when the mist generated on the inside of the frame body 10 floats above the board 15, the mist is blocked by the upper side surface 153 and is unlikely to reach the lower side surface 154 on which the optical sensor 151 is disposed. Since the optical sensor 151 is disposed on the lower side surface 154, the printer 1 can reduce the adhesion of the mist on the optical sensor 151 and can inhibit the deterioration of the printing quality.

As described above, the IC 152 is mounted on the lower side surface 154 (refer to FIG. 6). If the mist adheres to a pin section of the IC 152 and a section between patterns of the base 15 in the vicinity of the IC 152, there is a possibility of damage caused by a short circuit and occurrence of an erroneous operation of the IC 152. Since the IC 152 is disposed on the lower side surface 154, the printer 1 can reduce the adhesion of the mist on the IC 152 and can inhibit the deterioration of the printing quality.

Figure 9:
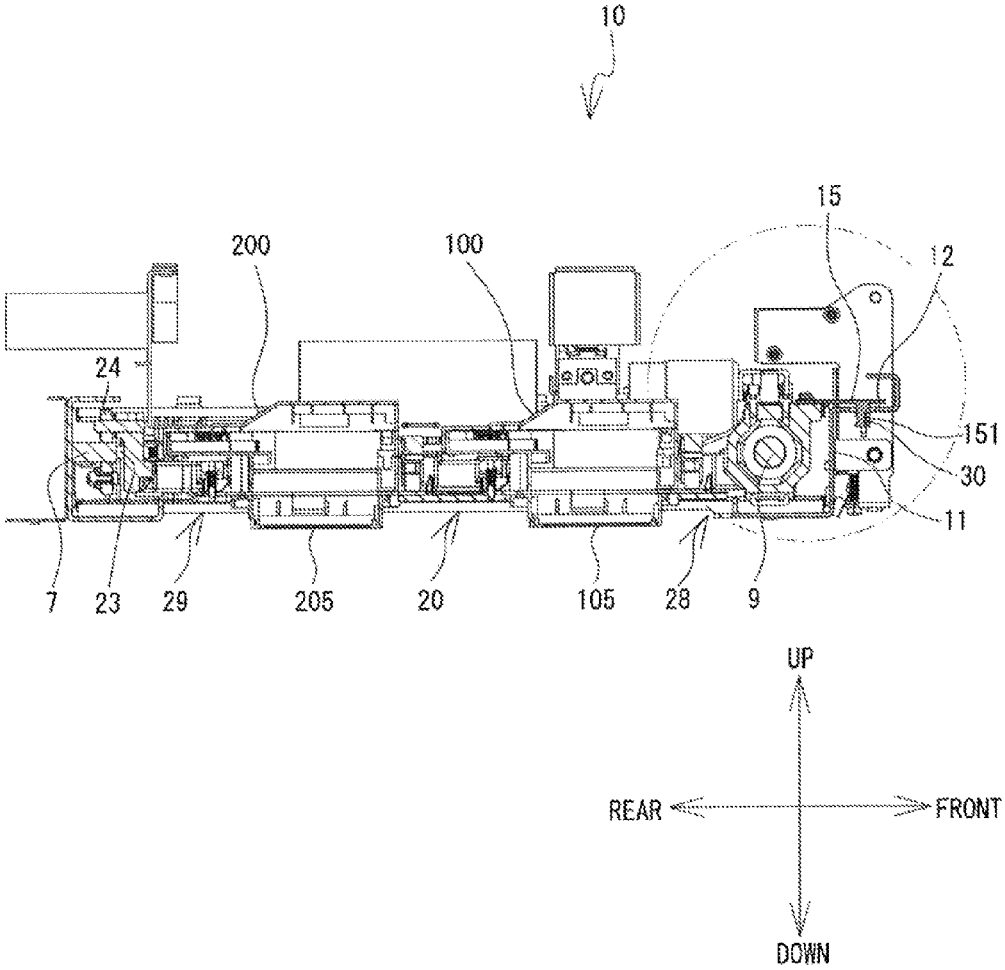
FIG. 9 is a sectional view taken in the direction of arrows along a line A-A shown in FIG. 4.

As shown in FIG. 7 and FIG. 9, when the head units 100 and 200 are arranged side by side in the first direction on the carriage 20, the length of the carriage 20 in the front-rear direction becomes relatively long. When the carriage 20 is conveyed in the left-right direction along the guide shaft 9, an acceleration in the left-right direction is applied to the carriage 20. The acceleration in the left-right direction that is applied to the carriage 20 exerts a load in the left-right direction on the carriage 20. The load exerted on the carriage 20 causes the carriage 20 to bend in the left-right direction, and causes an inclination in the left-right direction (the horizontal direction) from the center of the carriage 20. The first end portion 28 of the carriage 20 is supported by the guide shaft 9 via the support portions 21L and 21R. On the other hand, the second end portion 29 is only in contact with the rail 7 at the left side roller 22, the right side roller 23 and the upper side roller 24. Therefore, the influence of the inclination in the left-right direction (the horizontal direction) that has occurred in the carriage 20 is more likely to be exerted on the second end portion 29 side than on the first end portion 28 side. When the influence of the inclination in the left-right direction is different between the first end portion 28 side and the second end portion 29 side, there is a possibility that positional displacement may occur in the left-right direction between the first end portion 28 and the second end portion 29. In this case, due to the influence of the acceleration in the left-right direction that is applied to the carriage 20, there is a possibility that the position of each of the head units 100 and 200 in the left-right direction is displaced from the position initially positioned by the carriage 20. As a result, a landing position of the ink ejected from each of the head units 100 and 200 onto the print medium may be displaced from a predicted landing position in the left-right direction, and the printing quality of the printer 1 may deteriorate.

In the present embodiment, the carriage 20 positions the head unit 100, which ejects the color inks (the post-treatment inks), on the first end portion 28 side with respect to the head unit 200, which ejects the white ink (the pre-treatment ink). The first end portion 28 of the carriage 20 is supported by the guide shaft 9 via the support portions 21L and 21R. Therefore, the first end portion 28 is less likely to be affected by the inclination in the left-right direction that has occurred in the carriage 20 than the second end portion 29. The printer 1 can secure the printing quality by disposing the head unit 100, which ejects the post-treatment inks that are required to be ejected more accurately than the pre-treatment ink, on the first end portion 28 side, where it is less likely to be affected by the inclination in the left-right direction.

Further, in the present embodiment, the encoder strip 30 is disposed on the outside of the one side of the frame body 10 in the vicinity of the guide shaft 9. The optical sensor 151 is fixed to the first end portion 28 of the carriage 20. Distances in the front-rear direction from the encoder strip 30 and the optical sensor 151 to the head unit 100 are shorter than distances in the front-rear direction from the encoder strip 30 and the optical sensor 151 to the head unit 200. As described above, the encoder strip 30 and the optical sensor 151 are used to detect the position of the carriage 20 in the second direction. Therefore, by disposing the head unit 100 on the first end portion 28 side, the printer 1 can secure the printing quality.

As explained above, the carriage 20, on which the head units 100 and 200 are mounted, is disposed on the inside of the frame body 10. Therefore, particularly on the inside of the frame body 10, it is likely that the ink ejected from the head units 100 and 200 during printing by the printer 1 becomes mist and floats. The printer 1 is provided with the side wall portion 1 that covers the outside of the one side of the frame body 10 along the left-right direction, and the upper wall portion 12 that protrudes, in an overhang shape, to the one side from the upper end of the side wall portion 11. The mist is blocked by the side wall portion 11 and the upper wall portion 12, and is unlikely to float to the outside of the one side of the frame body 10. Further, the printer 1 includes the guide shaft 9 on the one side of the inside of the frame body 10, and includes the rail 7 on the other side. Therefore, the encoder strip 30 is disposed on the outside of the one side of the frame body 10 in the vicinity of the guide shaft 9. Then, the optical sensor 151 that detects the displacement detection pattern formed on the encoder strip 30 is also disposed on the outside of the one side of the frame body 10. Thus, the printer 1 can reduce the adhesion of the mist on the encoder strip 30, without providing a cover member.

The board 15, on which the optical sensor 151 is mounted, is screwed and fixed to the first end portion 28 of the carriage 20, at the end portion on the other side of the board 15. Thus, the end portion on the one side of the board 15 extends toward the upper side of the opening portion 13 that is disposed such that it overhangs the outside of the one side of the frame body 10. In summary, the board 15 is disposed such that it overhangs the upper side of the opening portion 13. Therefore, the printer 1 can inhibit the mist from passing through the opening portion 13 and dispersing below the opening 13. Therefore, the printer 1 can inhibit the mist from adhering to the encoder strip 30.

The optical sensor 151 and the IC 152 are provided on the lower side surface 154 that is most unlikely to be affected by the influence of the mist, among the surfaces of the board 15. Therefore, the printer 1 can reduce the adhesion of the mist on the optical sensor 151 and on the IC 152. Thus, the printer 1 can inhibit a failure due to contamination of the optical sensor 151 and the IC 152 by the mist.

The two fans 18 and 18 that are provided on the rear side end portion of the frame body 10 can discharge the mist generated on the inside of the frame body 10 from the one side toward the rear side, together with the air on the inside of the frame body 10. The mist is discharged toward the other side that is opposite to the outside of the one side of the frame body 10 on which the encoder strip 30 is disposed. Therefore, the printer 1 can further reduce the adhesion of the mist on the encoder strip 30 and on the optical sensor 151.

The head unit 100, which ejects the color inks for post-treatment onto the print medium onto which the white ink for pre-treatment has been ejected, is required to eject ink with a higher degree of accuracy than the head unit 200 that ejects the white ink. The optical sensor 151, which detects the displacement detection pattern formed on the encoder strip 30, is disposed on the first end portion 28 side of the carriage 20. Therefore, the head unit 100 that is disposed close to the optical sensor 151 can eject ink at a more accurate position than the head unit 200 that is disposed far from the optical sensor 151. Thus, the printer 1 can secure the printing quality.

Note that various modifications are possible to the above-described embodiment. For example, although the head units 100 and 200 are provided in the printer 1 such that they are arranged side by side in the front-rear direction, the printer 1 need not necessary be provided with the two head units 100 and 200. For example, the printer 1 may be provided with the single head unit 100 only. Further, three or more head units may be arrayed in the first direction on the carriage 20.

It is sufficient that the head unit 100 and the head unit 200 are arranged side by side in the front-rear direction. The two head units 100 and 200 need not necessarily be arranged in a straight line in the front-rear direction. For example, the positions of the head unit 100 and the head unit 200 may be displaced from each other in the left-right direction in a so-called zigzag arrangement, within a range in which the printing for pre-treatment and the printing for post-treatment can be performed in the same process. Further, in the above-described embodiment, the interior of each of the head portions 105 and 205 is divided into four sections along the left-right direction corresponding to the respective color inks. However, the number of the divided sections may be changed as appropriate from that described above.

The liquid supplied to the head units 100 and 200 is not limited to the above-described example. For example, the liquid may be ink of another color, such as gold, silver or the like. Further, for example, a treating agent to improve ink fixing may be used instead of the pre-treatment ink of the above-described embodiment, and a color ink may be used as a post-treatment liquid. For example, in discharge printing, a discharging agent may be used instead of the pre-treatment ink of the above-described embodiment, and a discharge ink may be used instead of the post-treatment ink of the above-described embodiment. In other words, it is sufficient that the liquid that can be ejected by the head units 100 and 200 is a liquid having characteristics, such as viscosity etc., that allow ejection from the head units 100 and 200. Therefore, the liquid is not limited to ink, and may be a chemical agent, such as a decoloring agent, for example. Further, as another example, the pre-treatment liquid and the post-treatment liquid may be the same type of liquid.

Further, the form of the ejection port group that is provided on each of the head units 100 and 200 is not limited to the above-described embodiment. For example, the head unit may be provided with a single ejection port group that ejects one type of liquid. The ejection port group that ejects the white ink and the ejection port group that ejects the color inks may be provided on the same head unit. Further, the head unit may include not only the ejection port group that ejects ink, but also an ejection port group that ejects a discharging agent, a discharge ink or the like.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer configured to perform printing by ejecting liquid onto a print medium which is fed in a first direction, the printer comprising:

a print head unit having an ejection portion configured to eject the liquid toward the print medium;

a carriage having the print head unit mounted thereon and configured to cause the ejection portion to reciprocate in a second direction orthogonal to the first direction;

a guide shaft provided along the second direction and configured to support the carriage;

a rail member provided along the second direction and disposed facing the guide shaft;

a frame body internally housing the guide shaft and the rail member, configured to support the guide shaft on a first side in the first direction, and also configured to support the rail member on a second side being opposite to the first side in the first direction, the frame body having a side wall portion and an upper wall portion, the side wall portion having a first surface, the first surface being an external surface on the first side of the frame body and being a surface extending toward a third direction in which the ejection portion ejects the liquid, the upper wall having a second surface, the second surface being an external surface on the first side of the frame body and being a surface extending toward the first side from an end portion of the side wall portion on a side of a fourth direction, the fourth direction being a direction opposite to the third direction, and the second surface having an opening portion extending along the second direction;

an object member to be detected, the object member having a pattern formed thereon, the pattern indicating a position of the carriage in the second direction, the object member having a strip shape and extending further to the first side than the first surface and further to a side of the third direction than the opening portion along the second direction; and a detection portion configured to output a detection signal based on the pattern, the detection portion being fixed to a first end portion which is an end portion on the first side of the carriage, and being provided such that the detection portion penetrates the opening portion from the side of the fourth direction with respect to the opening portion and protrudes toward the side of the third direction.

2. The printer according to claim 1, further comprising:

a board on which the detection portion is mounted, wherein the board extends from the first end portion toward a position at the side of the fourth direction than the opening portion.

3. The printer according to claim 1, wherein an electrical circuit, to which the detection signal is output from the detection portion, is mounted on a surface of the board on the side of the third direction, and the detection portion is electrically connected to the electrical circuit.

4. The printer according to claim 1, further comprising:

a discharge portion which is provided on an end portion on the second side of the frame body, and which is configured to discharge air from the first side toward the second side.

5. The printer according to claim 1, wherein the carriage is configured to arrange a first head unit, which is the print head unit, and a second head unit, which is the print head unit, such that the second head unit is on a side of the first end portion with respect to the first head unit, the first head unit is the print head unit which includes the ejection portion configured to eject a pre-treatment liquid onto the print medium, and the second head unit is the print head unit which includes the ejection portion configured to eject a post-treatment liquid, the post-treatment liquid being a liquid which is to be ejected onto the print medium onto which the pre-treatment liquid has been ejected by the first head unit.

* * * * *